US011167825B2

(12) United States Patent
Andersen et al.

(10) Patent No.: US 11,167,825 B2
(45) Date of Patent: Nov. 9, 2021

(54) ICEBREAKER

(71) Applicant: BIFROST TUG AS, Sagvåg (NO)

(72) Inventors: Steinar Andersen, Sagvåg (NO); Bjarne Engen, Bergen (NO)

(73) Assignee: BIFROST TUG AS, Sagvåg (NO)

( * ) Notice: Subject to any disclaimer, the term of this patent is extended or adjusted under 35 U.S.C. 154(b) by 18 days.

(21) Appl. No.: 16/763,766

(22) PCT Filed: Nov. 15, 2018

(86) PCT No.: PCT/NO2018/050280
§ 371 (c)(1),
(2) Date: May 13, 2020

(87) PCT Pub. No.: WO2019/098851
PCT Pub. Date: May 23, 2019

(65) Prior Publication Data

US 2020/0369349 A1 Nov. 26, 2020

(30) Foreign Application Priority Data

Nov. 15, 2017 (NO) ..... 20171809

(51) Int. Cl.
*B63B 35/08* (2006.01)
*B63B 35/12* (2006.01)

(52) U.S. Cl.
CPC ..... *B63B 35/083* (2013.01); *B63B 35/08* (2013.01); *B63B 35/12* (2013.01); *B63B 2211/06* (2013.01)

(58) Field of Classification Search
CPC ..... B63B 35/08; B63B 35/083; B63B 35/10; B63B 35/12; B63B 2211/06
USPC ..... 114/40–42
See application file for complete search history.

(56) References Cited

U.S. PATENT DOCUMENTS

| | | | | |
|---|---|---|---|---|
| 15,472 A * | 8/1856 | Brown et al. | ..... | B63B 35/08 114/41 |
| 77,366 A * | 4/1868 | Flannigain | ..... | B63B 35/08 114/41 |
| 857,766 A * | 6/1907 | Stangebye | ..... | B63B 35/08 114/41 |
| 3,521,591 A | 7/1970 | Alexander | | |

(Continued)

FOREIGN PATENT DOCUMENTS

| | | | | |
|---|---|---|---|---|
| DE | 2229621 B1 * | 6/1973 | ..... | B63B 35/12 |
| RU | 2122505 C1 | 11/1998 | | |

(Continued)

*Primary Examiner* — Ajay Vasudeva
(74) *Attorney, Agent, or Firm* — Flener IP & Business Law; Zareefa B. Flener

(57) ABSTRACT

Icebreaker (10) for a vessel (12), where the icebreaker (10) is connected to a bow (12*a*) of a vessel (12) for breaking up solid ice (40) floating on a water surface, the icebreaker (10) comprises a central part (14) sliding on a first side of the ice (40) and two or more side parts (16) sliding on an opposite part of the ice (40). The centre part (14) and the side parts (16) extend in parallel forward and works against each other when breaking the ice (40) to prevent the ice (40) from lifting, wherein a lower edge of the side parts (16), being in contact with the ice (40), is narrow and sharp to initiate breaking lines (50) in the ice (40), and the centre part (14) comprises a forward protruding cam structure (14*a*) to break the ice (40) between the side parts (16).

10 Claims, 3 Drawing Sheets

(56) References Cited

U.S. PATENT DOCUMENTS

| | | | | | |
|---|---|---|---|---|---|
| 3,636,904 | A | * | 1/1972 | Blanchet | B63B 35/08 114/41 |
| 3,658,024 | A | * | 4/1972 | Stoffel | B63B 35/10 114/40 |
| 3,706,295 | A | * | 12/1972 | Iozza | B63B 35/08 114/41 |
| 4,436,046 | A | * | 3/1984 | Braley | B63B 35/12 114/40 |
| 5,660,131 | A | | 8/1997 | Gulling et al. | |
| 7,779,771 | B2 | | 8/2010 | Immonen | |

FOREIGN PATENT DOCUMENTS

| | | | | |
|---|---|---|---|---|
| RU | 2612343 | C1 | | 3/2017 |
| SU | 956346 | A1 | * | 9/1982 |
| SU | 1230921 | A1 | | 5/1986 |
| WO | 2017072394 | A1 | | 5/2017 |

* cited by examiner

ICEBREAKER

FIELD OF THE INVENTION

The present invention relates to an icebreaker for a vessel, where the icebreaker is connected to a bow of a vessel for breaking up solid ice floating on a water surface. The icebreaker comprises a centre part sliding and abutting on a first side of the ice and two or more side parts sliding on an opposite part of the ice.

It is also a purpose to provide a solution that enables small vessels to break thick ice while the design of the icebreaker causes the ice to be lifted, glided, and pressed naturally under the ice on the sides so that the void becomes as clean as possible for broken ice. The method can be used on all sizes of vessels and on all types of ice.

BACKGROUND OF THE INVENTION

An icebreaker is traditionally a ship designed for sailing in ice-covered waters. Compared to other ships the icebreaker has reinforced hull and strong engines.

An icebreaker use the engine power to bring the bow upon the ice for breaking the ice by its weight. The hull is designed to lead the ice away under or around the hull.

DISCLOSURE OF STATE OF THE ART

U.S. Pat. No. 4,436,046 A refer to the bow of a ship designed with bowed ramps with cutting devices, which attack the ice from the underside.

DE2229621 refer to a separate plough formed icebreaker moored to the ships bow, which attack the ice from the underside.

RU2276037 C2 refer to an icebreaker which support the ice under side while a vertical moveable wedge formed unit cuts the top of the ice.

U.S. Pat. No. 7,779,771 B2 refer to an icebreaker formed as a trimaran.

U.S. Pat. No. 77,366 refer to an icebreaker with beams laying upon the ice while a plough formed unit attack the ice from the underside for cutting/breaking it. The sides of the unit have attached steel plates, which is cutting the ice from the top of the ice.

U.S. Pat. No. 77,366 shows in a closer view two parallel arms over the ice and a central part at an angle with straight front going under the ice. The parallel arms are on their underside, at the transition to the central part, equipped with teeth's for cutting a slice in the ice both on the over and under side of the ice, such that the ice is cut to the width between the arms and is broken up in bits and pieces by the central unit.

Reference is also made to U.S. Pat. Nos. 5,660,131 A, 7,779,771 B2, RU 2612343 C1 and WO 2017/072394 A1.

OBJECTS OF THE PRESENT INVENTION

It is an object of the invention to produce a new type of icebreaker where the ice is broken as a beam between the parts. A central part is breaking the ice up against side parts on each side resulting in a break line at each part. Longitudinal the ice breaks up due to the upward deformation initiated by the central part lifting. The central submerged part angles down to each side formed as a cam. This lifts and break the ice while the side parts slides upon the ice preventing the ice from lifting and as a result all vertical forces breaking the ice are internal between these parts.

The central parts low angle centre line lifts the ice as a wedge needing a small force in forward direction to produce a high lifting force. This makes it possible that a small ship with moderate engine power can break thick ice.

It is also the purpose to construct a solution where small ships can break thick ice and at the same time bring the ice away under the ice by the design lifting the ice to an angle where it slides naturally under the ice by its own weight and the form of the Icebreaker, and in particular the central part. This will leave the lane through the ice mostly free from ice. The method may be used on all sizes of ships and all types of ice. The icebreaker shown in the figures is a separate unit moored to the bow of the vessel, but the solution may also be incorporated as part of the ship.

SUMMARY OF THE INVENTION

According to the invention, an icebreaker for a vessel is provided, where the icebreaker is connected to a bow of the vessel for breaking up solid ice floating on a water surface. The icebreaker comprises a central part sliding and abutting a first side of the ice and two or more side parts sliding on an opposite part of the ice, wherein the centre part and the side parts extend in parallel forward with basically similar length and works against each other when breaking the ice to prevent the ice from lifting. A lower edge of the side parts, being in contact with the ice, is narrow and sharp to initiate breaking lines in the ice, and the centre part comprises a forward protruding cam structure to break the ice between the side parts.

Preferable, the attack points on the ice for the centre part and the side parts are on line with each other.

The forward protruding cam structure of the centre part can be a submerged part sliding partly under the ice floating on the surface, and the two or more side parts can be backing parts sliding upon the ice floating on the surface.

The forward protruding cam structure of the centre part can be arranged to lift and break the ice between the side backing parts.

The forward protruding cam structure of the centre part, and which is in contact with the solid ice, can comprise an inclined and sharp edge for initiating breaking lines in the ice.

The forward protruding cam structure of the centre part can be inclined towards the vessel's bow.

The side backing parts and the central submerged cam structure can be rigidly connected to each other.

The icebreaker can be a separate unit connected to the bow of the vessel.

The icebreaker may further be an integrated part of the vessel's bow.

One or more of the side parts can comprise a rear ice knife to further break up the ice.

One or more of the side parts may further comprise a right-angled runner extending longitudinally in a lower part of said side part.

The gap between the centre part and the side parts can be adjustable.

In one embodiment can the centre part be sliding upon the ice floating on the surface, and the two or more side parts can be submerged backing parts sliding under the ice floating on the surface.

DESCRIPTION OF THE FIGURES

The preferred embodiments of the invention will be presented in the following more detailed description with reference to the attached figures, where.

DESCRIPTION OF PREFERRED EMBODIMENTS OF THE INVENTION

Figure 1:
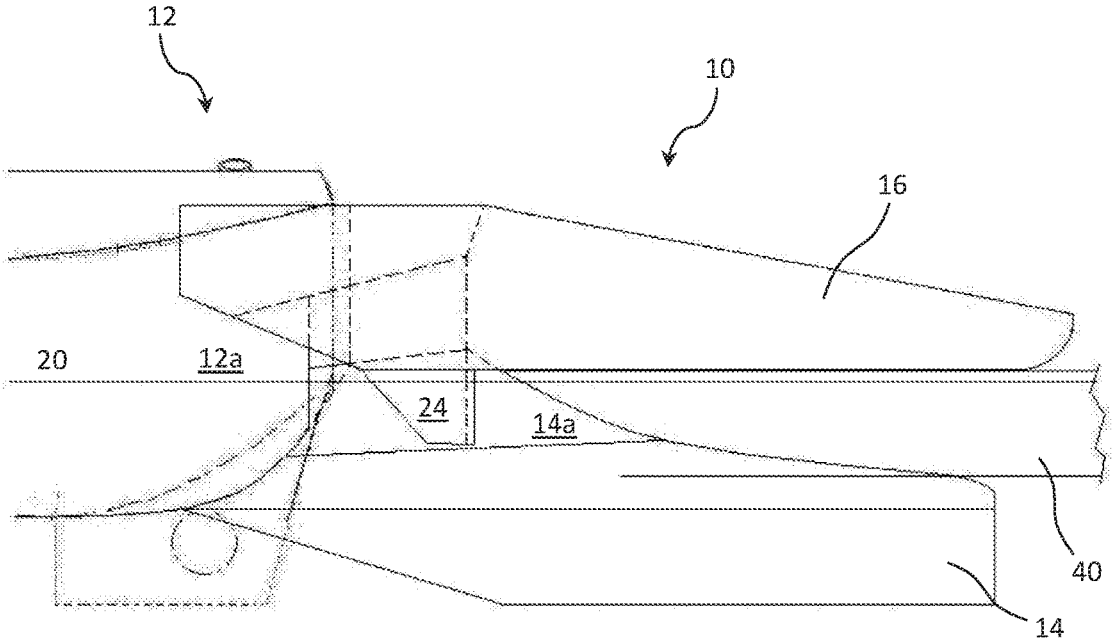
FIG. 1-3 shows principal sketches of one example embodiment according to the invention.

The invention comprises an icebreaker 10 designed with first connecting part 18 for connection to a bow 12*a* of a vessel 12. The connecting part 18 preferably has a cut out 28 shaped according to the bow 12*a* of the vessel 12.

For breaking up solid ice 40 floating on a water surface (reference number 20 indicates waterline of the vessel 12), the icebreaker 10 comprises a central part 14 sliding on a first side of the ice 40 and two or more side parts 16 sliding on an opposite part of the ice 40.

The centre part 14 and the side parts 16 extend in parallel forward and works against each other when breaking the ice 40 to prevent the ice 40 from lifting. The centre part 14 and the side parts 16 may extend forward with basically similar length. A lower edge of the side parts 16, being in contact with the ice 40, is narrow and sharp to initiate breaking lines 50 in the ice 40, and the centre part 14 comprises a forward protruding cam structure 14*a* to break the ice 40 between the side parts 16. The centre part 14 and the side parts 16 will, whether they extend forward with similar length or not, have respective attack points on the ice 40 that are on line with each other, i.e. on similar transverse line in front of the vessel.

The centre part 14 is in one embodiment a central submerged part 14 or structure, which is connected to the bow 12*a* on the vessel 12. The icebreaker 10 also have two, but may be more, sides parts 16 which slides upon the ice 40 and are acting as backings for the vertical forces from the centre part 14, thus providing a counter force. The icebreaker 10 will function similar if connected to the stern of the vessel if this should be practical.

Figure 4:
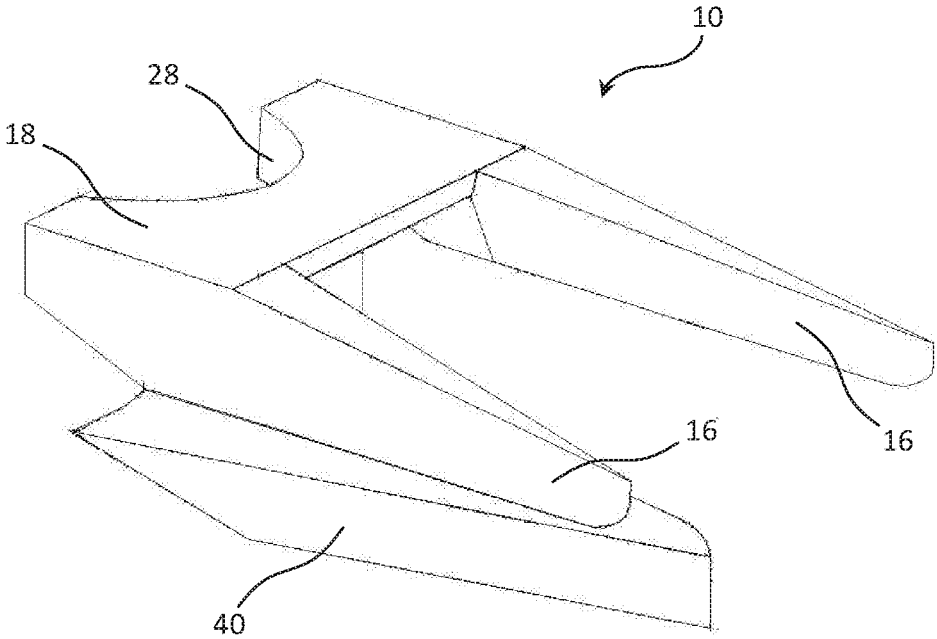
FIGS. 4 and 5 shows two embodiments of the invention.
Figure 5:
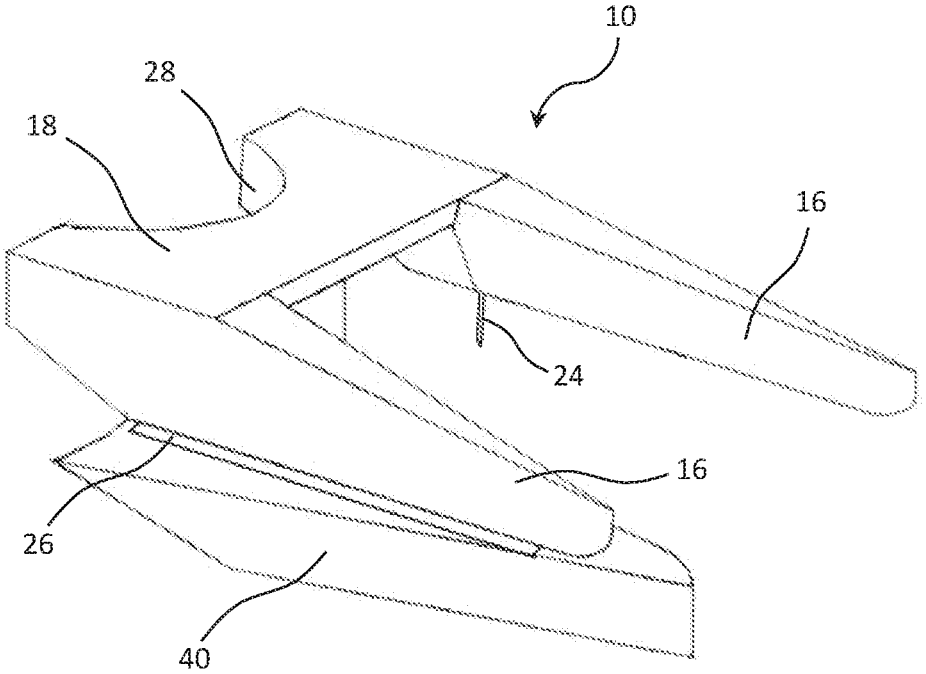

The centre part 14 is in FIGS. 4 and 5 hidden behind one of the side parts 16 and the ice 40.

Figure 2:
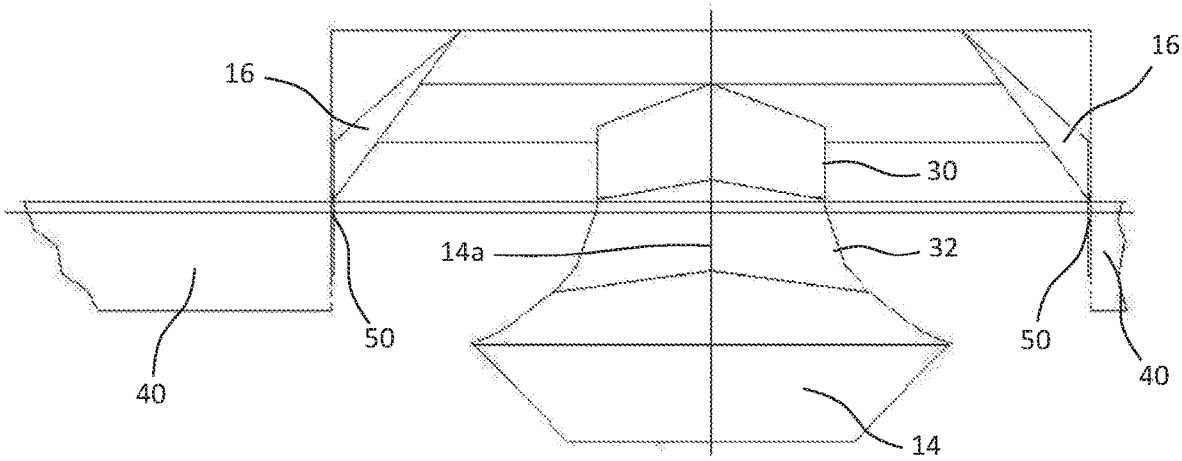
Figure 3:
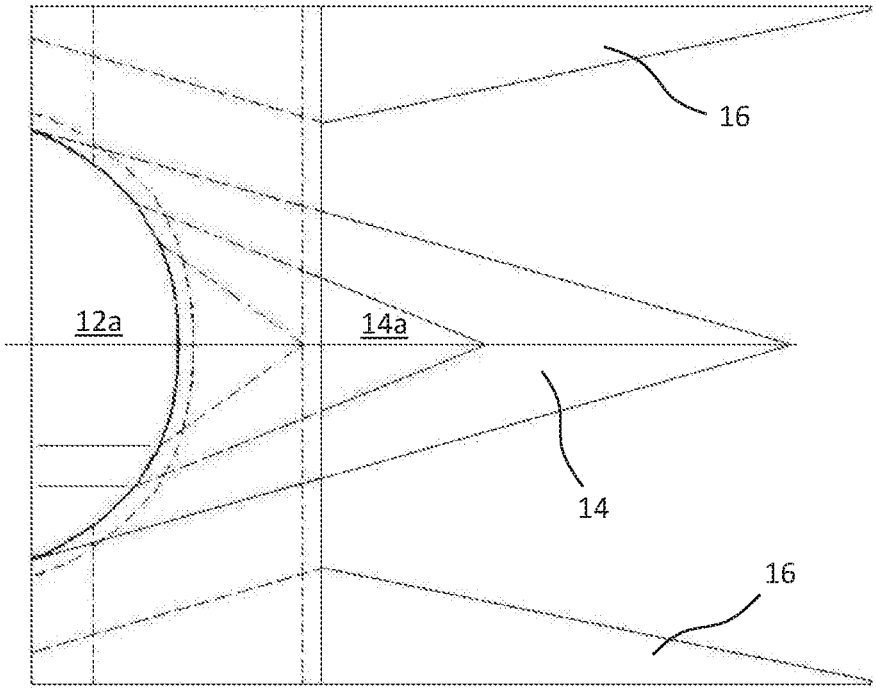

As apparent from FIGS. 2 and 3, the centre part 14 may have a foot like shape connected to a downward leg 30 extending from the connecting part 18. The "foot" can be shaped with side faces 32 inclining towards the leg 30, and wherein the forward protruding cam structure 14*a* extends towards the toe of the foot and constitutes the part of the foot facing upwards.

The icebreaker 10 is preferable used in a first position as shown in the enclosed figures, i.e. with the centre part 14 being submerged and the side parts 16 sliding on top of the ice 40, but the icebreaker 10 can also be used in an inverse position, i.e. with the centre part 14 hitting the top or upper part of the ice 40 and the side parts 16 being submerged. The invention is however disclosed in the application in the first position.

The invention relates to an icebreaker 10 where the ice 40 is broken with the side parts 16 as backing or holding parts on each side. In the centerline is the submerged structure 14, which is inclined or oblique from an upper part of the structure to a forward and lower part of the structure, thus providing the cam structure 14*a*. This lifts and break the ice, while the backing side parts 16 are sliding upon the ice 40, and are backing the vertical force from the central part 14 during breaking of the ice 40. The side parts 16 backing the central cam structure 14*a* are rigid connected to each other such that the forces breaking the ice are internal forces between the sides backing parts 16 and the centre cam structure 14*a*.

The central longitudinal heeling angle on the cam structure 14*a* gives the proportions between vertical ice breaking forces and the necessary horizontal propulsion force since the friction between steel and wet ice is very low and thus has relative little influence on the necessary propulsion. The central part 14 act as wedge under the ice and with low angle the increase of the propulsion force to the vertical ice breaking force are very high.

Ice on water can be quite elastic and distributes the load over large areas with the water as backing, but the strength in stretch is low and only one tenth of pressure thus failure in bending starts on the stretch side. This is used by this icebreaker 10 by restricting the area the breaking forces from the cam structure 14*a* acts on, and the distribution to the water below, by the side backing parts 16 such that the ice deformation immediately will be so large that the ice breaks, and the elastics of the ice is without influence. At the same time, the narrow contact area of the side parts 16 and the cam structure 14*a* acts almost as knifes concentrating the forces and forms breaking lines.

The mode of operation of the icebreaker 10 can be compared to bending of beams to failure as a stripe of the ice can be seen as, and which can be calculated as common beam theory. The strongest situation occur when the ice is unbroken and functions as a continues supported beam. In the second situation, the ice is simply supported on two sides, when the ice has broken on both sides only, then breaking the middle will require half the force in the first situation. In the third situation, the ice is supported on one side, and the ice has broken in the middle only, and breaking the two cantilever sides only require a quarter of the force in the first situation.

The above is the mechanical facts behind the ice breaking. The three parts of the icebreaker 10, i.e. the cam in the centre and a backing support on each side, functions as explained.

The backing supports are horizontal, while the centre cam has an angle. The forces breaking the ice are from the propulsion of the vessel, and acts normal to this in the following proportion;

Vessel pushing force/sin(cams angle)=force for breaking the ice

When the angle is low the sinus to the angle is small, and the small pushing force from the vessel divided by a very small number gives a large number, which is the situation for the breaking force initiated on the ice. There are as shown a large increase of the pushing forces due to the forces breaking the ice are internal between the parts of the icebreaker. This is an advantage with the invention.

The advantage is also that even small vessels can break thick ice 40 and that shape of the Icebreaker 10 lifts the ice to an angle where the broken ice naturally slides under the solid ice 40 and out of the lane after the icebreaker 10 such that the lane is free from most of the broken ice.

However, to improve that ice slides out of the lane of the icebreaker, the icebreaker 10 can be equipped with an ice knife 24, as seen in FIG. 5, that further breaks up and pushes the ice away. The ice knife 24 extends down from a lower part of the side parts 16, and can be placed in the rear of the side parts 16.

As seen in FIG. 5, the icebreaker 10 may also comprise a right-angled runner 26 or skid extending longitudinally in a lower part of the side parts 16, to support the side parts 16 on the ice 40 after the ice is broken.

This method can be used on all sizes of ships, and all types of ice.

To adapt the icebreaker 10 to ice of different thickness, the gap in vertical direction between the centre part 14 and the side parts 16 can be adjustable. For instance, the centre part 14 can be connected to hoisting equipment, hydraulic cylinders, etc., that can elevate the centre part 14.

In the attached figures, a special design is shown where the icebreaker 10 is a separate unit, floating by its own buoyancy, and is adapted to a small tug 12 and moored to it. The tug 12 pushes the icebreaker 10 in front of it for breaking the ice 40, and the clearance in the lane to the sides of the tug is as wide as the thickest ice it can break for safety reasons, but may be more if wanted. This gives much room for maneuvering the vessel, and the necessary room for the ice to slide under the solid ice 40 and out of lane.

The invention claimed is:

1. An Icebreaker (10) for a vessel (12), where the icebreaker (10) is connected to a bow (12*a*) of the vessel (12) for breaking up solid ice (40) floating on a water surface, the icebreaker (10) comprises a centre part (14) sliding and abutting a first side of the ice (40) and two or more side parts (16) sliding on an opposite part of the ice (40), the centre part (14) and the side parts (16) extend in parallel forward and works against each other when breaking the ice (40) to prevent the ice (40) from lifting, a lower edge of the side parts (16), being in contact with the ice (40), is narrow and sharp to initiate breaking lines (50) in the ice (40), and one or more of the side parts (16) comprises a downward extending rear ice knife (24) to further break up the ice (40), the centre part (14) comprises a forward protruding cam structure (14*a*) to break the ice (40) between the side parts (16), the forward protruding cam structure (14*a*) of the centre part (14), which is in contact with the solid ice (40), comprises an inclined and sharp edge for initiating breaking (50) lines in the ice (40), and the centre part (14) has a foot like shape and is connected to a downward extending leg (30) from a connecting part (18), and the centre part is shaped with side faces (32) inclining up toward the leg (30).

2. The icebreaker (10) according to claim 1, wherein attack points on the ice (40) for the centre part (14) and the side parts (16) are on line with each other.

3. The icebreaker (10) according to claim 1, wherein the forward protruding cam structure (14*a*) of the centre part (14) is a submerged part sliding partly under the ice (40) floating on the surface, and the two or more side parts (16) are backing parts sliding upon the ice (40) floating on the surface.

4. The icebreaker according to claim 3, wherein the side backing parts (16) and the central submerged cam structure (14*a*) are rigidly connected to each other.

5. The icebreaker according to claim 1, wherein the forward protruding cam structure (14*a*) of the centre part (14) is inclined towards the vessel's bow (12*a*).

6. The icebreaker according to claim 1, wherein the icebreaker (10) is a separate unit connected to the bow (12*a*) of the vessel (12).

7. The icebreaker (10) according to claim 1, wherein the icebreaker (10) is an integrated part of the vessel's (12) bow (12*a*).

8. The icebreaker (10) according to claim 1, wherein one or more of the side parts (16) comprises a right-angled runner (26) extending longitudinally in a lower part of said side part (16).

9. The icebreaker (10) according to claim 1, wherein a gap between the centre part (14) and the side parts (16) is adjustable.

10. The icebreaker (10) according to claim 1, wherein the centre part (14) is sliding upon the ice (40) floating on the surface, and the two or more side parts (16) are submerged backing parts sliding under the ice (40) floating on the surface.

* * * * *